US008453762B2

(12) United States Patent
Law et al.

(10) Patent No.: US 8,453,762 B2
(45) Date of Patent: Jun. 4, 2013

(54) REGENERATIVE DRIVE MECHANISM FOR HYDRAULIC FEED CYLINDERS IN HYDROSTATIC OR HYDRAULIC CIRCUITS

(75) Inventors: Arnold Law, Garland, TX (US); Neil Skoog, Ostrander, OH (US)

(73) Assignee: Atlas Copco Drilling Solutions, Inc., Garland, TX (US)

( * ) Notice: Subject to any disclaimer, the term of this patent is extended or adjusted under 35 U.S.C. 154(b) by 158 days.

(21) Appl. No.: 12/755,928

(22) Filed: Apr. 7, 2010

(65) Prior Publication Data

US 2011/0278068 A1 Nov. 17, 2011

(51) Int. Cl.
*E21B 7/00* (2006.01)

(52) U.S. Cl.
USPC ..... 175/57; 175/107; 175/217; 175/162; 137/14

(58) Field of Classification Search
USPC ..... 175/107, 217, 57, 105, 189; 137/14
See application file for complete search history.

(56) References Cited

U.S. PATENT DOCUMENTS

2009/0008151 A1* 1/2009 Turner et al. ..... 175/45

* cited by examiner

*Primary Examiner* — Yong-Suk (Philip) Ro
(74) *Attorney, Agent, or Firm* — Robert O. Groover, III

(57) ABSTRACT

Methods and systems for storing kinetic energy in a fluid-base power circuit. A regenerative control valve manifold diverts fluid flow from a hydraulic device performing a first operation into an accumulator. The accumulator stores a fluid volume sufficient to perform a second operation. The regenerative control valve manifold connects the accumulator to the power circuit providing a fluid flow and charge pressure sufficient to perform the second operation.

10 Claims, 3 Drawing Sheets

PARALLEL HYDROSTATIC DRIVE UTILIZING FEED CYLINDER

SERIES HYDROSTATIC DRIVE UTILIZING FEED CYLINDER

OPEN CIRCUIT DRIVE UTILIZING FEED CYLINDER

REGENERATIVE DRIVE MECHANISM FOR HYDRAULIC FEED CYLINDERS IN HYDROSTATIC OR HYDRAULIC CIRCUITS

BACKGROUND

The present application relates to hydraulic systems, and more particularly to a regenerative drive for hydraulic cylinders in hydrostatic circuits in a drilling rig.

In a typical drilling operation, the kinetic energy of lowering the drill string is converted to heat through some form of braking mechanism, either mechanical or hydraulic. Typically, this energy is lost and not recovered. It requires additional energy to raise the drill head in order to add or to unload another section of drill steel.

The lost energy from lowering the drill string can be considerable. Harnessing the energy within a hydrostatic system for further use by another hydraulic machine is desirable. A regenerative drive can be used to recover and store the kinetic energy generated by lowering the drill string. This stored energy can then used to raise the drill head or to operate other machinery.

SUMMARY

The present application discloses new approaches to operating a hydrostatic circuit in a drilling rig more efficiently to avoid heat build-up and wasting energy using a regenerative drive.

In some embodiments, the inventions include a regenerative drive that consists of one or more hydraulic accumulators and a control valve manifold to divert the fluid out of and into the lowering end of a feed circuit. The control valve manifold directs fluid into the accumulator and controls the flow rate of the fluid to provide speed control. The accumulator(s) can be sized to accommodate the entire fluid requirement of the feed mechanism or utilize an intensifier circuit to store a small volume of fluid at high pressure. When reversed, the accumulator provides a large volume of fluid at a lower pressure. This large fluid volume is sufficient to raise the drill head. The control valve can be adapted to either open circuit hydraulic systems or closed circuit hydrostatic hydraulic systems, using cylinders or motors to raise and lower the drill head.

The disclosed innovations, in various embodiments, provide one or more of at least the following advantages. However, not all of these advantages result from every one of the innovations disclosed, and this list of advantages does not limit the various claimed inventions.

Increased speed control over a hydraulic actuator.

Less heat build-up.

Less energy wasted.

Less energy usage over time to raise and lower a drill string.

Allows a smaller motor for a given work operation.

BRIEF DESCRIPTION OF THE DRAWINGS

The disclosed inventions will be described with reference to the accompanying drawings, which show important sample embodiments of the invention and which are incorporated in the specification hereof by reference, wherein.

DETAILED DESCRIPTION OF SAMPLE EMBODIMENTS

The numerous innovative teachings of the present application will be described with particular reference to presently preferred embodiments (by way of example, and not of limitation). The present application describes several inventions, and none of the statements below should be taken as limiting the claims generally.

Figure 1:
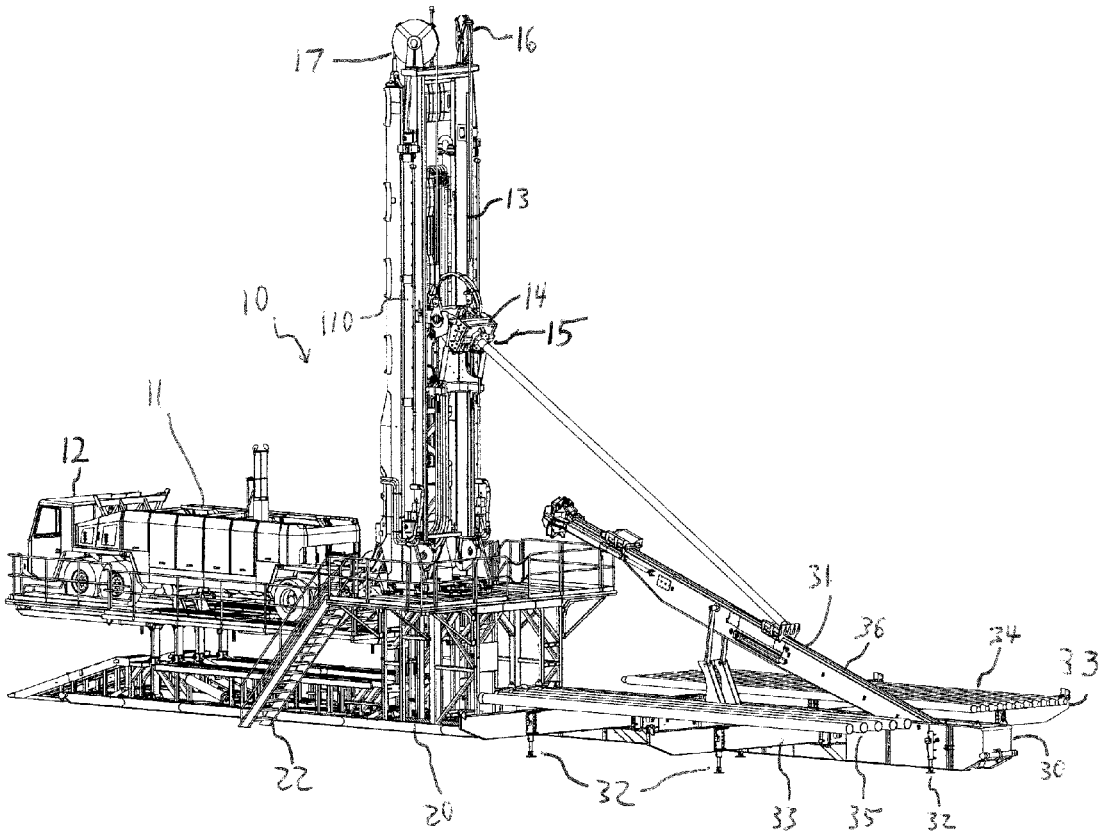
FIG. 1 schematically shows a drilling rig compatible with the inventions.

The exemplary drilling rig depicted in FIG. 1 is a new generation drill for the oil and gas industry. This innovative drilling rig system includes three primary structural components: a mobile rig (10), a substructure (20), and a pipe handling skate (30). The three components are designed to provide a modular, highly mobile drilling system, offering improved drilling performance, lowering operating cost, and enhancing safety. The modular drilling system exhibits exceptional mobility with vastly reduced rig-up time, greatly reducing non-drilling time and cost, improved performance, greater energy efficiency, and enhanced safety in all facets of operation.

The exemplary top-drive rig possesses an actual working hook load capacity of 200,000 lb (90,719 kg) and the flexibility to drill vertical, directional and horizontal wells. In most prior art systems, the rigs can only perform actual drilling operations for approximately half the time it is deployed for a drilling assignment. These older designs rig spend the remainder of the time mobilizing, rigging up, handling pipe, and standing by while other operations occur. This design focuses on reducing non-drilling time and costs, increasing operating performance, and enhancing safety.

Enhancements of this design include a virtually hands-free breakout and pipe handling system 31 requiring minimal manual intervention and eliminating the need for personnel in the mast during drilling operations. Another enhancement includes a hydraulic floor crane on the substructure 20 assisting rig up and drilling operations, which reduces heavy lifting and additional manual intervention The exemplary drilling system can be utilized in a mixed fleet approach which permits land-based drilling to capitalize on the strengths of two types of drilling rigs: lightweight mobile rigs and deep-hole conventional rigs. The lightweight hydraulic top-drive exemplary rig drills surface holes and pre-sets casing. The larger rig follows on and drills the deeper segment of the well, which allows both rigs to perform at maximum efficiency. Each rig completes its portion of the drilling plan in the least amount of time and at the lowest possible cost. This approach results in a considerable savings in mobilization costs, rig-up time, setting surface casing, tripping pipe, and rig down.

Component Overview

Hydraulic Carrier Drive

The exemplary drilling rig shown in FIG. 1 uses a unique single-engine hydraulic carrier-drive system 11 to power the rig's existing systems. The carrier 11 design possesses a full-width, low-profile cab 12 with all of the amenities found in conventional trucks. A single 950 hp (708 kw) engine powers both the carrier and the drilling rig's hydraulic and electrical systems utilizing shared components rather than a second engine plus drive train. This unique design greatly reduces weight as well as time and cost for maintenance.

In drive mode, the engine consumes less than half of its rated power and is capable of full torque at any time, regardless of speed. The hydraulic drive, coupled with a clutch and manual transmission, provides a wide range of power and speeds, equally effective on flat land or mountainous terrain. A dynamic braking system provides both improved quiet and efficient operation compared to conventional braking systems. The carrier 11 also possesses a creep mode feature that gives the driver precise control and vehicle placement in off-road or extreme driving conditions.

Mobile Drill Rig

The disclosed exemplary rig 10 is a mobile, self-contained rig with a 200,000 lb (90718 kg) hook load capacity. It incorporates a unique telescopic mast 13 that reduces overall rig-transport length while maintaining the capability to handle both pipe and casing. The pipe handling and breakout system 31 is virtually hands free. Its dual-range hydraulic top-drive 14 tips out to handle drill pipe and casing with a 0° to 90° tip out design. The rig also possesses an integrated iron roughneck 21 and hydraulic slips. The drill operator can set a top-drive torque limit control to a maximum torque limit so that every joint of pipe and casing is made up to exact specification. The design allows the rig to push, pull, rotate, and flush tubulars.

The mast 13 and substructure 20 are engineered to API 4-F with a 3 to 1 safety factor over maximum hook load. A hydraulic cylinder hoisting and pulldown system provides high mechanical and hydraulic efficiency, which may reduce operating cost. The hoisting and pulldown system operates using a dual hydraulic cylinder feed and hoisting configuration. Cables 17 reeved over large diameter traveling sheaves 16 raise the top-drive 14 to the top of the mast 13 at maximum extension. The electronic control system is designed to be precise and reliable. An "on demand" hydraulic system allows the driller to allocate power to various drilling systems as needed. This capability can improve drilling performance and reduce operating cost. The operator's console and monitor can be placed either on the work floor or in a drill cabin. The rig provides the operator with real-time surface and down-hole information to maximize drilling performance at all times.

Substructure

The rig substructure 20 serves as a strong, structural base for the rig and makes up an integral part of the drilling system. The substructure design allows rapid rig up with reduced manual labor and assembly. The substructure 20 includes as integrated components the table, master bushing, hydraulic slips, and iron roughneck. Four hydraulic blocking jacks permit simple, fast leveling. A self-contained electric-hydraulic power pack system deploys the drive-on ramps and catwalks on the substructure. The blowout preventer (BOP) stack can be transported with the substructure. A hydraulic crane, with a telescoping boom, assists with rig up and utility lifting during drilling operations. A remote controlled crane boom can be positioned over hole center or can reach off the work floor to pick up loads from the ground. The main air/mud manifold is also located on the substructure for quick ground level hook up.

The substructure forms a large 190 $ft^2$ (17.6 $m^2$) work floor designed to provide ample working space and configured with drill-crew efficiency and safety in mind. Two access stairways 22 hinged at the top can adjust to substructure height, while keeping the bottom end firmly on the ground. Because the substructure 20 comprises a single load, deployment requires less assembly and manual labor than prior art substructures, reducing non-drilling time and cost.

Skate

The rig's skate 30 forms a complete pipe handling system designed to work with the rig 10 and substructure 20. It comprises a single skid-mounted load attached directly behind the substructure 20. The skate design allows handling of drill pipe, collars, and casing. The skate 30 can handle 30 ft (9 m) or 40 ft (12 m) oil field drill pipe as well as lengths of casing up to 24 inches (610 mm) in diameter. Hydraulic jacks 32 make set up and alignment quick and simple. The skate possesses foldout pipe racks 33 on both sides to store pipe 34 and casing 35. These racks 33 use hydraulic jacks so pipe will roll onto the skate when drilling and off the skate when tripping out. Alternatively, the skate configuration can omit racks and use hydraulic pipe tubs or simple A-frame racks to load and unload the skate.

The control system for pipe handling can be located on the work floor and/or at ground level. An operator handles the loading operation on the skate and elevates the pipe to a fixed position behind the work floor on a trough 36. A hydraulic clamp on the end of the trough 36 grips the pipe, and the clamp extends to meet the spindle 15 for make up. After the joint is made up, the operator opens the clamp and retracts it into the trough 36. The operator then lowers the trough 36 and loads the next pipe 34 or casing 35 from the racks 33. A big advantage of this totally automated pipe handling system is the ability to maintain a constant, fast pipe-handling speed without tiring crewmembers.

The disclosed integrated drilling system offers contractors a lightweight, mobile package that can be mobilized and rigged up quickly. It can drill vertical, directional, and horizontal exploration and production wells in the 6,000-10,000 ft (1800-3000 m) depth range, and can handle drilling and casing surface and intermediate holes for deeper wells.

An accumulator offers increased efficiency in a hydraulic circuit by energy recovery and storage. The disclosed accumulator solution can store the potential energy available from lowering drill steel (i.e., drill pipe), and allows the stored kinetic energy to be used to raise the drill head back up or aid raising the drill head and attached drill steel back up. This is similar to a hybrid vehicle that takes the energy from braking and stores it to be used in accelerating, but in this case the kinetic energy from tripping in is stored.

The main benefit to the exemplary drilling rig is during the tripping phase of drilling operations. For example, if it is necessary to replace a worn out drill bit at 4800 ft depth, with each length of drill steel approximately 40 ft long, a feed cylinder component needs to make 120 trips to pull the drill steel out of the hole. While pulling the drill steel up, i.e., dripping out, no energy can really be recovered since all the work required to pull the steel up must be provided by a pump. However, once the bit is replaced, then we need to lower the steel and bit back into the hole, i.e., tripping in. The weight of the steel×40 ft is the amount of work available to be recovered. (NOTE: Work is measured in foot-pounds, Power measured in Horsepower or Watts includes a time element: ft-lbs/time) The disclosed accumulator in the regenerative drive mechanism provides a system that can absorb this work and discharge it at two different rates of time. Conceptually, as a drill head lowers the drill steel, the fluid flow from the feed cylinder is diverted into the accumulator. At the end of the length of steel, a valve manifold reverses the fluid flow, allowing the accumulator to discharge the fluid back into the feed cylinder. The unloaded drill head (i.e., empty) can be raised very quickly, without a large flow rate of fluid being required from the pump. The feed cylinder requires a fixed volume of oil to extend it. How quickly the system supplies that volume affects pump size (flow rate). Using an accumulator in a regenerative drive mechanism allows a reduced pump size.

The regenerative drive mechanism accumulator can slowly absorb energy from a small steady state pump for a long time period and discharge it quickly for a short period of time, which offers another advantage to using the accumulator. While drilling, the feed cylinder is being lowered slowly and a small pump could charge the accumulator. Once reaching the end of the 40 ft section of steel, the valve manifold connects the recently charged accumulator to rapidly raise the head for another section of steel. If it requires 30 minutes to drill, but only 30 seconds to raise the head, the pump could potentially be 1/60th the size using the accumulator, as opposed to not using the accumulator. However, the caveat is that the accumulator loses pressure (force) as it discharges, so the weight it can lift may be limited.

Description of Typical Operation

Figure 2:
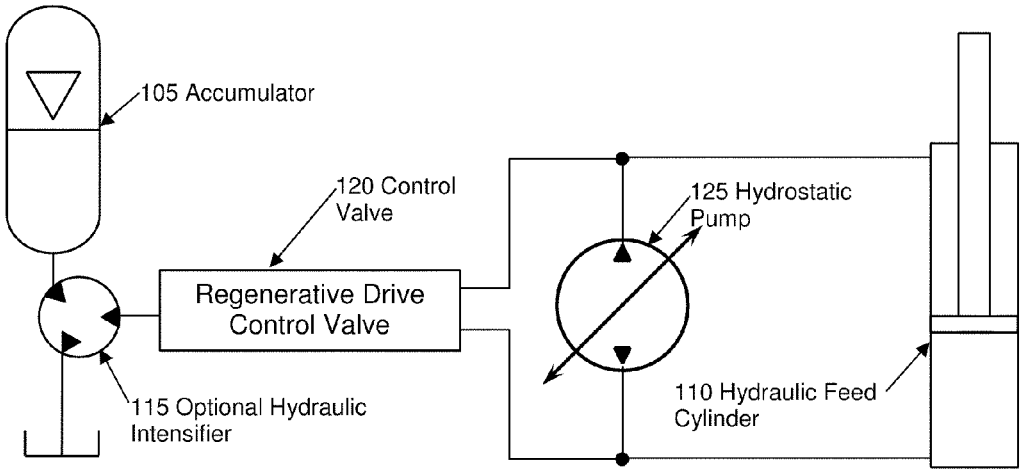
FIG. 2 schematically shows an embodiment using the regenerative drive in a parallel hydrostatic drive.
Figure 3:
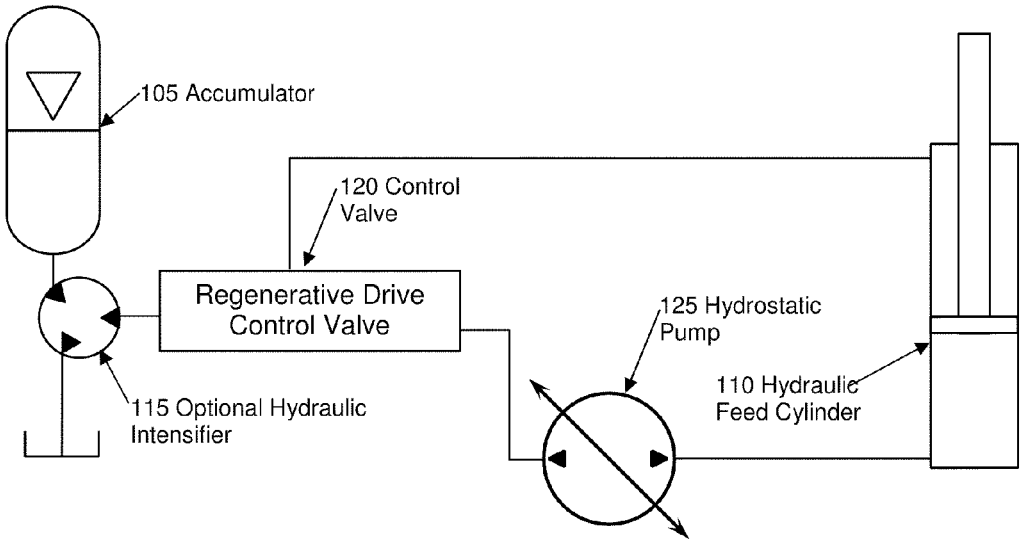
FIG. 3 schematically shows an embodiment using the regenerative drive in a series hydrostatic drive.
Figure 4:
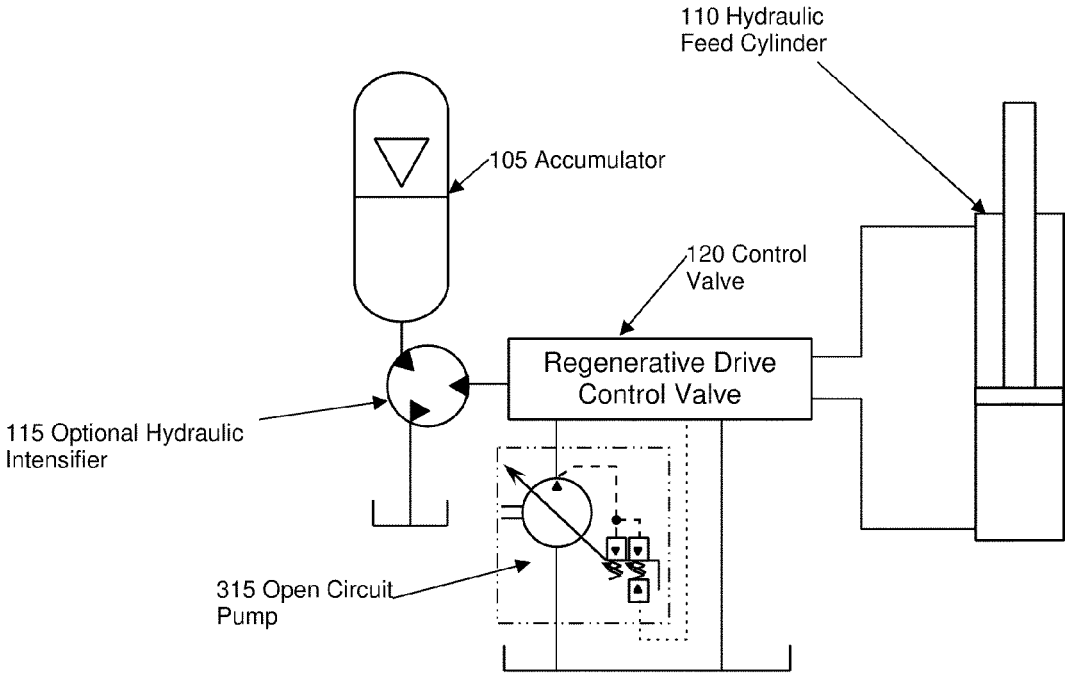
FIG. 4 schematically shows an embodiment using the regenerative drive in an open circuit drive.

Parallel Hydrostatic Drive:

A parallel hydrostatic circuit is shown in FIG. 2. The accumulator 105 is sized to accept the volume of fluid necessary to raise the feed cylinder(s) 110 used in this example. Using the optional hydraulic intensifier 115 will permit reduced fluid volume, but increased storage pressure. The weight of drill steel the feed system can lift may be limited using the intensifier method.

When lowering the drill head during tripping in, fluid is directed from the hydraulic cylinder 115 into accumulator 105 via the regenerative drive control valve 120. The hydrostatic pump 125 is not required for this function. The regenerative drive control valve 120 operates as a flow control to limit the lowering speed of the drill head via operating the hydraulic feed cylinder 110. When the drill head reaches the end of its travel in lowering mode, the drill steel is disconnected from the drill head and the drill head is raised to load another section of drill steel.

During this function, the regenerative drive control valve 120 directs fluid from the charged accumulator 105 into the hydraulic feed cylinder 110. The charged accumulator 105 provides the necessary fluid flow to operate the hydraulic feed cylinder 110 to raise the drill up and back into position to accept another section of drill steel. As the hydraulic feed cylinder 110 lowers the drill steel into the well bore, the control valve 120 directs the fluid flow into the accumulator 105, restoring charge pressure in the hydrostatic circuit sufficient to operate the hydraulic feed cylinder 110. If necessary, the hydrostatic pump 125 provides supplemental fluid flow to increase the speed of the drill head or to make up for any losses due to internal leakage. The optional hydraulic intensifier 115 can alternatively be used to increase storage pressure, so the necessary operating charge pressure is maintained.

In the parallel circuit, the regenerative drive control valve 120 provides the metering function to control the lowering speed of the feed cylinder 115. Some power is wasted in the form of heat due to the potential pressure differences of the load induced cylinder 110 pressure vs. the low initial pressure of the discharged accumulator 105. As the accumulator 105 becomes charged, the pressure differential falls. The maximum pressure in the accumulator 105 equals the load induced pressure in the feed cylinder.

Series Hydrostatic Drive:

The accumulator 105 is sized to accept the volume of fluid necessary to raise the feed cylinder(s) 110 used in this example. Using the optional intensifier 115 permits reduced fluid volume, but increased storage pressure. The weight of drill steel the feed system can lift may be limited using the intensifier method.

When lowering the drill head, fluid is directed from the hydraulic cylinder 110 into accumulator 105 via the regenerative drive control valve 120. The hydrostatic pump 125 is primarily used to meter the flow exiting the hydraulic cylinder 110 into the regenerative drive control valve 120, thereby controlling the cylinder speed. To raise the drill head, the regenerative drive control valve 120 directs the stored, pressurized hydraulic fluid from the accumulator 105 into the hydrostatic pump 125. The hydrostatic pump 125 is used to control the fluid flow rate into the hydraulic cylinder 110. When lowering the drill head, the regenerative drive control valve 120 directs the hydraulic fluid into the accumulator 105 to re-pressurize the accumulator 105 to an operating charge pressure.

The series circuit allows the hydrostatic pump 125 to act as the metering device, and the potential pressure difference can convert to mechanical energy by rotating the shaft of the hydrostatic pump 125. This mechanical energy can drive other pumps for auxiliary functions. Another possible benefit is increasing the accumulator stored pressure to a value higher then the load induced pressure 110.

Open Circuit Drive:

The accumulator 105 is sized to accept the volume of fluid necessary to raise the feed cylinder(s) 110 used in this embodiment. Using the optional intensifier 115 will permit reduced fluid volume, but increased storage pressure. The weight of drill steel the feed system can lift may be limited using the intensifier method.

When lowering the drill head, fluid is directed from the hydraulic cylinder 110 into accumulator 105 via the regenerative drive control valve 120. The open circuit pump 315 is not required for this function. The regenerative drive control valve 120 contains a flow control to limit the lowering speed of the drill head. When the drill head reaches the end of its travel in lowering mode, the drill steel is disconnected from the drill head and the drill head is raised to load another section of drill steel. During this function, the regenerative drive control valve 120 directs fluid from the charged accumulator 105 into the hydraulic cylinder 110.

The charged accumulator 105 provides the necessary fluid flow to operate the hydraulic feed cylinder 110 to raise the drill head up and back into position to accept another section of drill steel. As the hydraulic feed cylinder 110 lowers the drill steel into the well bore, the control valve 120 directs the fluid flow into the accumulator 105, restoring charge pressure in the hydrostatic circuit sufficient to operate the hydraulic feed cylinder 110. If necessary, the open circuit pump 315 can provide supplemental flow to increase the speed of the drill head or to make up for any losses due to internal leakage. Additionally, the open circuit pump 315 can be used to provide the initial charge to the accumulator 105 when the system is first stared if the drill head is already in the lowered position to lift the drill head. The optional hydraulic intensifier 115 can alternatively be used to increase storage pressure, so the necessary operating charge pressure is maintained.

In the open circuit configuration, the regenerative drive control valve 120 provides the metering function to control the lowering speed of the feed cylinder 110. Some power is wasted in the form of heat due to the potential pressure differences of the load induced cylinder 110 pressure vs. the low initial pressure of the discharged accumulator 105. As the accumulator 105 becomes charged, the pressure differential falls. The maximum pressure in the accumulator 105 equals the load induced pressure in the feed cylinder.

Using the optional hydraulic intensifier 115, the stored pressure in the accumulator 105 can be increased by a magnitude of 2-10 times. Since hydraulic power is GPM (gallons per minute)×PSI (pounds per square inch)/1714, increasing the stored PSI reduces the GPM proportionally. For a fixed time period, the G (gallons) can be reduced, allowing a smaller, lighter accumulator 105.

Typically, for tripping operations, a large displacement pump or combination must provide sufficient power for the fast feed function to raise the head. If using the accumulator 105 in a regenerative drive mechanism, this pump combination can be reduced in size. With an accumulator 105 properly sized for both flow and pressure, the hydrostatic/hydraulic system can raise a fully loaded drill string with a much smaller pump 125. The pump 125 could then be used to recharge the accumulator during the lowering or stationary time, or, alternatively, the intensiver 115 can recharge the cylinder 110 (i.e., during portions of the drilling cycle that use low fluid flow rates). The accumulator 105 can then discharge the volume at a high flow rate to provide a short high flow requirement.

The accumulator 105 can also be configured in a stand-by mode to provide emergency power in the event of an engine failure. The accumulator would be severely limited to the number of trips, but even if limited to one or two, it still offers reasonable benefit.

Note that although the exemplary embodiments use feed cylinders 110, other hydraulic actuators can work with the regenerative drive, including motor applications as well. In one example, controlling the drill head can be accomplished with an inverted cylinder (the cylinder extends to lower the head) or with a motor though a system of cables or chain drive. For example, an electric motor can be used to slowly lower the drill string into the well-bore during tripping, with fluid diverted into an accumulator. At the end of lowering, stored energy in the accumulator can be used to rapidly raise the drilling head back into position. The accumulator system will work with all of these.

The accumulator 105 itself can be in several possible configurations. For example, the accumulator 105 can consist of a vertical cylinder containing fluid. The cylinder can comprise a piston loaded with a series of weights exerting a downward force on the piston to thereby energize the fluid in the cylinder at a charge pressure. In contrast to compressed gas and spring accumulators, this type of accumulator delivers a nearly constant pressure, regardless of the volume of fluid stored.

A compressed gas accumulator comprises a cylinder with two chambers separated by an elastic diaphragm, totally enclosed bladder, or a floating piston. One chamber contains hydraulic fluid, and the other chamber contains an inert gas under pressure (typically nitrogen) providing a compressive force on the hydraulic fluid to provide a charge pressure. As the volume of the compressed gas changes the pressure of the gas, and the pressure on the fluid, changes inversely.

A spring type accumulator is similar to the gas-charged accumulator above, except that a heavy spring (or springs) is used to provide the compressive force. According to Hooke's law the magnitude of the force exerted by a spring is linearly proportional to its extension, so as the spring compresses, the force exerted increases.

A metal bellows type accumulator functions similarly to the compressed gas type, except a hermetically sealed welded metal bellows replaces the elastic diaphragm or floating piston. Fluid may be internal or external to the bellows. The advantages to the metal bellows type include exceptionally low spring rate, allowing the gas charge to work with little change in pressure from full to empty, and a long stroke relative to empty height, giving maximum storage volume. The welded metal bellows accumulator provides an exceptionally high level of accumulator performance, and can be produced with a broad spectrum of alloys resulting in a broad range of fluid compatibility. Another advantage is that it does not face issues with high pressure operation and allows more energy storage capacity.

Finally, the simplified schematic figures provided do not disclose any safety interlocks. In actual use, the valving includes features to safely discharge any trapped fluid prior to maintenance being performed on the system. Depending on the configuration, a safety circuit can consist of a failsafe bleed down valve that discharges anytime the system powers down, or a bleed down-holding valve for using the accumulator as an emergency backup. In that case, the accumulator would not bleed down with a power loss so as to provide the necessary fluid required to operate the machine for a limited number of cycles.

An important innovative element to the accumulator is to recover the energy that is being slowly produced by the drilling operation and send it back quickly when raising the head empty to load another section of pipe. The time differential is several minutes for drilling per section of pipe versus seconds of travel to up to reload the pipe.

The foregoing has described methods and systems for a regenerative drive mechanism in hydrostatic and hydraulic circuits that are given for illustration and not for limitation and uses. Thus the inventions are limited only by the appended claims. Although the inventions have been described in accordance with the embodiments shown, one of ordinary skill in the art will readily recognize that there could be variations to the embodiments and those variations would be within the spirit and scope of the present inventions. Accordingly, many modifications may be made by one of ordinary skill in the art without departing from the spirit and scope of the appended claims.

According to various embodiments, there is provided: A regenerative drive mechanism for a hydraulic device, comprising: an accumulator connected to a regenerative control valve manifold; a hydraulic machine connected to the regenerative control valve manifold, with fluid flow from the machine under a load diverted into the accumulator; wherein the accumulator stores energy by collecting fluid flow from a hydraulic machine under a load and providing fluid flow back into the hydraulic machine at a charge pressure sufficient to operate the hydraulic machine.

According to various embodiments, there is provided: A hydraulic power circuit in a drill rig, comprising: an accumulator connected to a regenerative control valve manifold; a hydraulic feed cylinder for raising and lowering a drill head connected to the regenerative control valve manifold, with the accumulator sized to accommodate the entire fluid requirement of the feed cylinder; wherein the accumulator stores kinetic energy by collecting all the displaced fluid flow from the feed cylinder when lowering drill steel with the drill head, so that when reversed, a large volume fluid flow sufficient to raise the drill head is provided.

According to various embodiments, there is provided: An accumulator circuit that provides a fluid flow to operate a hydraulic device, comprising: a regenerative control valve manifold connected to an accumulator sized to accept an entire fluid requirement sufficient to operate the hydraulic device through a complete function cycle; wherein the accumulator stores kinetic energy by collecting all the displaced fluid flow from the hydraulic device when performing a first function under a load, so that when reversed by the regenerative control valve manifold, a large volume of fluid at a sufficient pressure exits the accumulator to perform a second function.

According to various embodiments, there is provided: A hydraulic power system, comprising: a fluid-based power circuit powered by a fluid pump to provide fluid flow to a hydraulic actuator; an accumulator connected to a regenerative control valve manifold thereby coupled to the fluid-based power circuit; the hydraulic actuator connected to the regenerative control valve manifold; an intensifier interposed between the regenerative control valve manifold and the accumulator to increase the pressure of a fluid flow; wherein the accumulator stores kinetic energy by collecting displaced fluid flow from the hydraulic device when performing a first operation.

According to various embodiments, there is provided: A power system circuit, comprising: a fluid pump providing fluid flow to a hydraulic actuator; a regenerative control valve manifold coupling an accumulator to the power system circuit; wherein the accumulator stores kinetic energy from displaced fluid flow from the hydraulic device when performing a first operation, so when reversed, the accumulator provides the entire fluid flow at a charge pressure to the hydraulic actuator to perform a second operation; and wherein interposed intensifier provides the displaced fluid flow to the accumulator at an increased pressure so as to store fluid at a higher pressure.

According to various embodiments, there is provided: A fluid-based power circuit, comprising: an accumulator coupled to a fluid pump in the fluid-based power circuit by a regenerative drive control valve manifold; wherein the regenerative drive control valve manifold during a low flow rate first operation diverts fluid from the fluid pump into the accumulator to recharge the accumulator; and wherein the regenerative drive control valve manifold switches to a reverse state to discharge a volume of fluid from the accumulator to provide a short high flow requirement for a second operation.

According to various embodiments, there is provided: A method for operating an accumulator, comprising the steps of: diverting an entire fluid requirement sufficient to operate a hydraulic device into the accumulator using a regenerative control valve manifold connecting the accumulator to a fluid powered circuit; storing kinetic energy in the accumulator by collecting all the displaced fluid flow from a hydraulic device when performing a first function; and reversing flow using the regenerative control valve manifold, so a large volume of fluid at lower pressure exits the accumulator to provide sufficient fluid flow to perform a second function.

According to various embodiments, there is provided: A method for operating a hydraulic regenerative drive mechanism, comprising the steps of: connecting a fluid-based power circuit to an accumulator circuit using a regenerative control valve manifold; diverting fluid flow with the regenerative control valve manifold from the fluid-based power circuit during a first operation into an accumulator sufficient to perform at least one additional operation; wherein the accumulator stores kinetic energy collected from one operation to provide the fluid flow sufficient to perform at least a second operation.

According to various embodiments, there is provided: A method for storing kinetic energy in a power system, comprising the steps of: forcing a displaced fluid flow from a hydraulic actuator when performing a first operation by exerting a pressure load on the hydraulic actuator; diverting said fluid to an accumulator via a coupling regenerative control valve manifold; intensifying the pressure of said fluid flow with an intensifier circuit interposed between the hydraulic actuator and the accumulator to store the fluid at an increased pressure; wherein the accumulator stores kinetic energy from the displaced fluid flow, and the regenerative control valve manifold goes to a reversed condition, providing the entire fluid flow to the hydraulic actuator to perform a second operation.

According to various embodiments, there is provided: A method for storing kinetic energy in an accumulator, comprising the steps of: diverting an entire fluid requirement sufficient to operate a hydraulic device into the accumulator using a regenerative control valve manifold connecting the accumulator to a fluid powered circuit; storing kinetic energy in the accumulator by collecting all the displaced fluid flow from a hydraulic device when performing a first function; boosting storage pressure using an intensifier interposed between the regenerative control valve manifold and the accumulator; and reversing flow using the regenerative control valve manifold, so a volume of fluid exits the accumulator at a charge pressure and fluid flow sufficient to perform a second function.

According to various embodiments, there is provided: A method for using a fluid pump in a fluid-based power circuit, comprising the steps of: coupling an accumulator to the fluid pump in the power circuit using a regenerative drive control valve manifold; diverting fluid with the regenerative drive control valve manifold from the fluid pump into the accumulator to recharge the accumulator during a low flow rate first operation; and switching to a reverse state in the regenerative drive control valve manifold to discharge a volume of fluid from the accumulator to provide a short high flow requirement for a second operation.

Modifications and Variations

As will be recognized by those skilled in the art, the innovative concepts described in the present application can be modified and varied over a tremendous range of applications, and accordingly the scope of patented subject matter is not limited by any of the specific exemplary teachings given. It is intended to embrace all such alternatives, modifications and variations that fall within the spirit and broad scope of the appended claims.

The exemplary embodiments show one accumulator. Multiple accumulators can be used in the system.

In one variation of a multi-accumulator system, the different accumulators can be used to provide fluid at different selected pressures to selectively vary and control the speed of drill head movement.

The disclosed accumulator stores energy for reuse in a given hydrostatic or hydraulic circuit, but it can be connected to different circuits, storing energy for use to transfer fluid from one circuit to another.

The hydrostatic circuit and open circuit embodiment depicted is exemplary only. The regenerative drive mechanism can be incorporated into any hydraulic circuit, including circuits lacking cylinders.

The regenerative drive mechanism concept is particular useful where heavy loads are encountered that can be used to charge an accumulator. It is very useful where multiple cylinders are encountered, where the cylinders are mechanically synchronized or otherwise linked to function in unison. In one possible variation, it is possible to have one accumulator and regenerative drive operating in multiple systems, with accumulated fluid delivering flow and causing a charge pressure from the accumulator in one or multiple systems. Logic controlled valving can be used to both distribute fluid and accumulate fluid. Similarly, multiple systems can be connected to a common accumulator or multiple interconnected accumulators, controlled using logic valving to provide charge pressure and fluid as required for the operating circuit(s).

Drilling is not always vertical; horizontal drilling is very common, also known as directional drilling. Although many times the hole starts from a vertical position. The described regenerative drive mechanism can be used in directional drilling.

The regenerative drive mechanism can be incorporated and used in pneumatic power circuits as well. Rather than hydraulic, analogous pneumatic systems can utilize the claimed inventions to store energy in a pneumatic power system.

None of the description in the present application should be read as implying that any particular element, step, or function is an essential element which must be included in the claim scope: THE SCOPE OF PATENTED SUBJECT MATTER IS DEFINED ONLY BY THE ALLOWED CLAIMS. Moreover, none of these claims are intended to invoke paragraph six of 35 USC section 112 unless the exact words "means for" are followed by a participle.

The claims as filed are intended to be as comprehensive as possible, and NO subject matter is intentionally relinquished, dedicated, or abandoned.

What is claimed is:

1. A method for operating an earth-penetrating drill rig, comprising:

operating a rotary drill bit at an end of a drill string in a borehole, to penetrate into the earth;

wherein vertical travel of said drill string is controlled by at least one hydraulic actuator; and wherein said operating includes, at various times, actions of a) during drilling, progressively retracting said hydraulic actuator under load from the weight of said drill string during lowering the drill string into the borehole, to thereby permit the drill bit to keep drilling, while also routing pressurized discharge from said hydraulic actuator to an accumulator; and b) as additional elements need to be added to the drill string during said action (a), then temporarily detaching the drill string, and extending the hydraulic actuator under a load which is less than the weight of the drill string, while discharging pressurized fluid from said accumulator into said hydraulic actuator;

wherein said action (a) scavenges and stores gravitational energy from descent of said drill string, and said action (b) recycles said energy to work against gravity.

2. The method of claim 1, further comprising operating a pump, with a horsepower less than a hydraulic horsepower of said discharging in said action (b), to gradually recharge said accumulator.

3. The method of claim 1, further comprising forcing fluid into said accumulator at an increased pressure using an intensifier interposed between said actuator and said accumulator.

4. The method of claim 1, further comprising augmenting fluid flow to said hydraulic actuator.

5. The method of claim 1, wherein said accumulator discharges fluid with sufficient volume and pressure to operate the hydraulic actuator for at least one operation when a power loss occurs.

6. The method of claim 1, wherein said accumulator discharges fluid quickly over a short time period to rapidly operate said hydraulic actuator.

7. A method for operating an earth-penetrating drill rig, comprising:

operating a rotary drill bit at an end of a drill string in a borehole, to penetrate into the earth;

wherein vertical travel of said drill string is controlled by at least one hydraulic actuator; and wherein said operating includes, at various times, actions of a) during drilling, progressively retracting said hydraulic actuator under load from the weight of said drill string during lowering the drill string into the borehole, to thereby permit the drill bit to keep drilling, while also routing pressurized discharge from said hydraulic actuator to an accumulator; and b) as additional elements need to be added to the drill string during said action (a), then temporarily detaching the drill string, and extending the hydraulic actuator under a load which is less than the weight of the drill string, while discharging pressurized fluid from said accumulator into said hydraulic actuator;

wherein said action (a) scavenges and stores gravitational energy from descent of said drill string, and said action (b) recycles said energy to work against gravity; and forcing fluid into the accumulator at an increased pressure using an intensifier interposed between the hydraulic actuator and the accumulator.

8. The method of claim 7, further comprising operating a pump, with a horsepower less than a hydraulic horsepower of said discharging in said action (b), to gradually recharge said accumulator.

9. A method for operating an earth-penetrating drill rig, comprising:

operating a rotary drill bit at an end of a drill string in a borehole, to penetrate into the earth;

wherein vertical travel of said drill string is controlled by at least one hydraulic actuator; and wherein said operating includes, at various times, actions of a) during drilling, progressively retracting said hydraulic actuator under load from the weight of said drill string during lowering the drill string into the borehole, to thereby permit the drill bit to keep drilling, while also routing pressurized discharge from said hydraulic actuator to an accumulator; and b) as additional elements need to be added to the drill string during said action (a), then temporarily detaching the drill string, and extending the hydraulic actuator under a load which is less than the weight of the drill string, while discharging pressurized fluid from said accumulator into said hydraulic actuator;

wherein said action (a) scavenges and stores gravitational energy from descent of said drill string, and said action (b) recycles said energy to work against gravity; and augmenting fluid flow to said hydraulic actuator.

10. The method of claim 9, further comprising operating a pump, with a horsepower less than hydraulic horsepower of said discharging in said action (b), to gradually recharge said accumulator.

* * * * *